US008968009B2

(12) United States Patent
Chen

(10) Patent No.: US 8,968,009 B2
(45) Date of Patent: Mar. 3, 2015

(54) ELECTRICAL CONNECTOR

(71) Applicant: OUPIIN Electronic (Kunshan) Co., Ltd, Kunshan (CN)

(72) Inventor: Hsin Chih Chen, Kunshan (CN)

(73) Assignee: OUPIIN Electronic (Kunshan) Co., Ltd., Kunshan (CN)

( * ) Notice: Subject to any disclaimer, the term of this patent is extended or adjusted under 35 U.S.C. 154(b) by 0 days.

(21) Appl. No.: 14/024,847

(22) Filed: Sep. 12, 2013

(65) Prior Publication Data

US 2014/0206241 A1 Jul. 24, 2014

(30) Foreign Application Priority Data

Jan. 21, 2013 (CN) ..... 2013 1 0019996

(51) Int. Cl.

| | |
|---|---|
| ***H01R 12/00*** | (2006.01) |
| ***H01R 12/70*** | (2011.01) |
| *H01R 12/72* | (2011.01) |
| *H01R 13/11* | (2006.01) |
| *H01R 107/00* | (2006.01) |

(52) U.S. Cl.

CPC ..... *H01R 12/7088* (2013.01); *H01R 12/724* (2013.01); *H01R 13/113* (2013.01); *H01R 2107/00* (2013.01)

USPC ..... 439/79

(58) Field of Classification Search

USPC ..... 439/79, 947, 607.09

See application file for complete search history.

(56) References Cited

U.S. PATENT DOCUMENTS

| | | | | |
|---|---|---|---|---|
| 6,402,566 | B1 * | 6/2002 | Middlehurst et al. | 439/699.1 |
| 7,726,982 | B2 * | 6/2010 | Ngo | 439/79 |
| 8,662,923 | B2 * | 3/2014 | Wu | 439/595 |

* cited by examiner

*Primary Examiner* — Phuong Dinh

(57) ABSTRACT

An electrical connector is provided in the present invention, including an insulating housing, multiple power terminals and multiple signal terminals. The insulating housing has at least one upright power receptacle body and at least one upright signal plug body parallel to the power receptacle body. Wherein the power receptacle body forms an upright power port on a front surface thereof, and the signal plug body forms at least one signal port on a front surface thereof. Each power terminal has a plate-shaped base plate, at least one spring connection end and multiple tails. The power receptacle body and the signal plug body of the present invention are designed to be upright for saving the edge space of a circuit board. Moreover, the electrical connector of the present invention also has a character of zero insertion force by controlling the length of the signal terminal and the power terminal.

10 Claims, 6 Drawing Sheets

ELECTRICAL CONNECTOR

CROSS REFERENCE TO RELATED APPLICATION

This application claims the priority of Chinese Patent Application No. 201310019996.6, filed on Jan. 21, 2013 in the SIPO (State Intellectual Property Office of the P.R.C.).

BACKGROUND OF THE INVENTION

1. Field of the Invention

The present invention relates to a connector technical field, and particularly relates to a compact electrical connector that is power and signal mixed.

2. Description of Prior Art

An electrical connector includes electrical features of durable and convenient and is applicable in various industrial and commercial usages such as a power supply, a server, a router, a storage device, an industrial controller and a modular chassis etc. In the meanwhile, since several terminal configurations can be designed in the connector, applications of power source, signal and the combination thereof can be satisfied.

At present, there are a great many of manufacturers striving to introduce electrical connectors that are designed power and signal mixed, yet the common ones are low-rise mixed electrical connectors whose height coverage is relatively small but whose design of a pro-longed shape takes too much edge of the circuit board, and as there is limited edge of a circuit board, no more numbers of other types of connectors can be included. Therefore, this sort of low-rise mixed electrical connectors is only applicable in an electronic device that has a strict control on the height of electrical connector and is unable to satisfy an electronic device which requires scalability on the edge of a circuit board.

As a result, in the light of the defects and inconvenience in the described conventional electrical connectors, a new electrical connector shall be designed, which includes power and signal terminals that are designed to satisfy the requirement of DC power supply. In the innovative electrical connector, the configuration of power and signal terminals are re-designed, the structure is properly optimized, thereby settling the problems in the abovementioned conventional technology.

SUMMARY OF THE INVENTION

One objective of the present invention is to provide an electrical connector whose layout of power terminal and signal terminal is compact and can save the edge space of a circuit board and enhance the air circulation in a power system of the electrical connector, thereby providing a power transmission and distribution of high efficiency.

Other objectives and advantages of the present invention are described in detail from the technical features disclosed in the present invention.

To achieve the objectives, the present invention provides: an electrical connector which comprises an insulating housing, a plurality of power terminals and a plurality of signal terminals. The insulating housing has an upright insulating base, at least one upright power receptacle body forward protruding from a front surface of the insulating base, and at least one upright signal plug body forward protruding from the front surface of the insulating base and parallel to the power receptacle body, wherein in the insulating base, at least one signal terminal assembling space and at least one power terminal receiving passage passing through the front surface, back surface and bottom surface thereof are formed; and the power receptacle body forms a vertical power port on the front surface thereof, and the power port is connected to the power terminal receiving passage, and the signal plug body forms at least one signal port in a front surface thereof, and the signal port is connected to the signal terminal assembling space; each of the power terminals is retained and mounted into the power terminal receiving passage of the insulating base, and each of the power terminal has a plate-shaped base plate, at least one spring connection end forward bent and extending from one side of the base plate, and a plurality of tails downward extending from another side of base plate perpendicular to the one side, wherein the base plate is retained into the power terminal receiving passage of the insulating base, the spring connection end extends into the power port of the power receptacle body, and the tail extends outside the bottom surface of the insulating base; the spring connection end comprises an inclining section connecting to the base plate, a contacting section connecting to the inclining section and a guiding section connected to the contacting section and disposed at the free end of the spring connection end; and each of the signal terminals is retained and mounted into the signal terminal assembling space of the insulating base, wherein each of the signal terminals has a head and a tail perpendicular to the head, wherein the head extends into the signal port of the signal plug body, and the tail extends outside the bottom surface of the insulating base; the heads of the signal terminals in the signal port being arranged straight in line vertically, and the tails are also arranged straight in line and perpendicular to the direction the heads arranged.

In one of the embodiments, the power terminals are divided into two groups which comprises a first group of power terminals and a second group of power terminals, the first group of power terminals is structurally larger than the second group of power terminals by size, the first group of power terminals and second group of power terminals are jointly assembled into the power port, each group of power terminals includes two pieces of the power terminals, and the base plate of each piece of power terminals in the first group of power terminals is shaped as an upside-downed L, and the base plate of each piece of power terminals in the second group of power terminals is shaped as a rectangle.

In one of the embodiments, the guiding sections of spring connection ends of two pieces of power terminals in each of the groups of power terminals extend from each other while the contacting sections are converging to each other to jointly form an elastic engagement structure.

In one of the embodiments, the heads of the signal terminals in the signal port exceed the docking ends of each of the power terminals in the first group of power terminals and second group of power terminals.

In one of the embodiments, the electrical connector includes two of the power receptacle bodies which are forward protruding in parallel from the front surface of the insulating base and are both upright, and each of the two power receptacle bodies has the power port, the power ports of the two power receptacle bodies are parallel to each other, the signal plug bodies are disposed at one side of the two power receptacle bodies, and an open structure is formed on a side of signal plug body facing the two power receptacle bodies, thereby making the signal port to be semi-enclosed.

In one of the embodiments, these power terminals are divided into four groups which comprises a first group of power terminals, a second group of power terminals, a third group of power terminals and a forth group of power terminals, the first group of power terminals and third group of power terminals are structurally larger than the second group of power terminals and forth group of power terminals by size, wherein the first group of power terminal and second group of power terminals are jointly assembled into the power port of one of the power receptacle bodies, and the third group of power terminal and forth group of power terminals are jointly assembled into the power port of another one of the power receptacle bodies; each of the groups of power terminals comprises two pieces of the power terminals, and the base plate of each power terminal in the first group of power terminals and third group of power terminals is shaped as an upside-downed L, while the base plate of each power terminal in the second group of power terminals and forth group of power terminals is shaped as a rectangle.

In one of the embodiments, the guiding sections of spring connection ends of two pieces of power terminals in each of the groups of power terminals extend from each other while the contacting sections are converging to each other to jointly form an elastic engagement structure.

In one of the embodiments, the heads of the signal terminals in the signal port exceed the docking ends of each of the power terminals in the four groups of power terminals, and the docking ends of the first group of power terminals and second group of power terminals that are in the same power port, compared to that of the third group of power terminals and forth group of power terminals that are in another power port, are slightly shorter.

In one of the embodiments, a straight-lined guiding groove is respectively formed in each of the two outside walls of each of the power receptacle bodies, and at least one opening hole connecting the power interface is disposed in both the top surface and bottom surface of the power receptacle body, and a plurality of opening holes are disposed in the top surface of the insulating base to be connected to the corresponding power terminal receiving passages and signal terminal receiving passages.

In one of the embodiments, a plurality of protrusions are formed on the base plate of each of the power terminals, and some of the protrusions are directed at another power terminal of this group of power terminals to contact the power terminal; and some other protrusions are directed at an opposite direction to contact the inside wall of the corresponding power terminal receiving passage in the insulating base.

Compared with conventional technologies the present invention includes following advantages: the power receptacle body and signal plug body in the electrical connector according to the present invention are both designed to be upright or vertical so as to save the edge space of a circuit board and allowing a larger number of connecter ports of same or other kinds to be mounted onto the edge of the circuit board; the electrical connector according to the present invention includes a character of zero insertion force and is operable to control the electrical performance of the electrical connector during docking by the length design of the signal terminal and the power terminal; also, through the opening holes and gap, can enhance the air circulation in power system and thereby improving the performance of the electrical connector; moreover, via the structural design of the straight-lined guiding grooves, the docking of the electrical connector is further provided with convenience.

DETAILED DESCRIPTION OF THE INVENTION

The following embodiments are exemplified by referring to the accompanying drawings, for describing specific embodiments implemented by the present invention. Furthermore, directional terms described by the present invention, such as upper, lower, front, back, left, right, inner, outer, side and etc., are only directions by referring to the accompanying drawings, and thus the used directional terms are used to describe and understand the present invention, but the present invention is not limited thereto.

Figure 1:
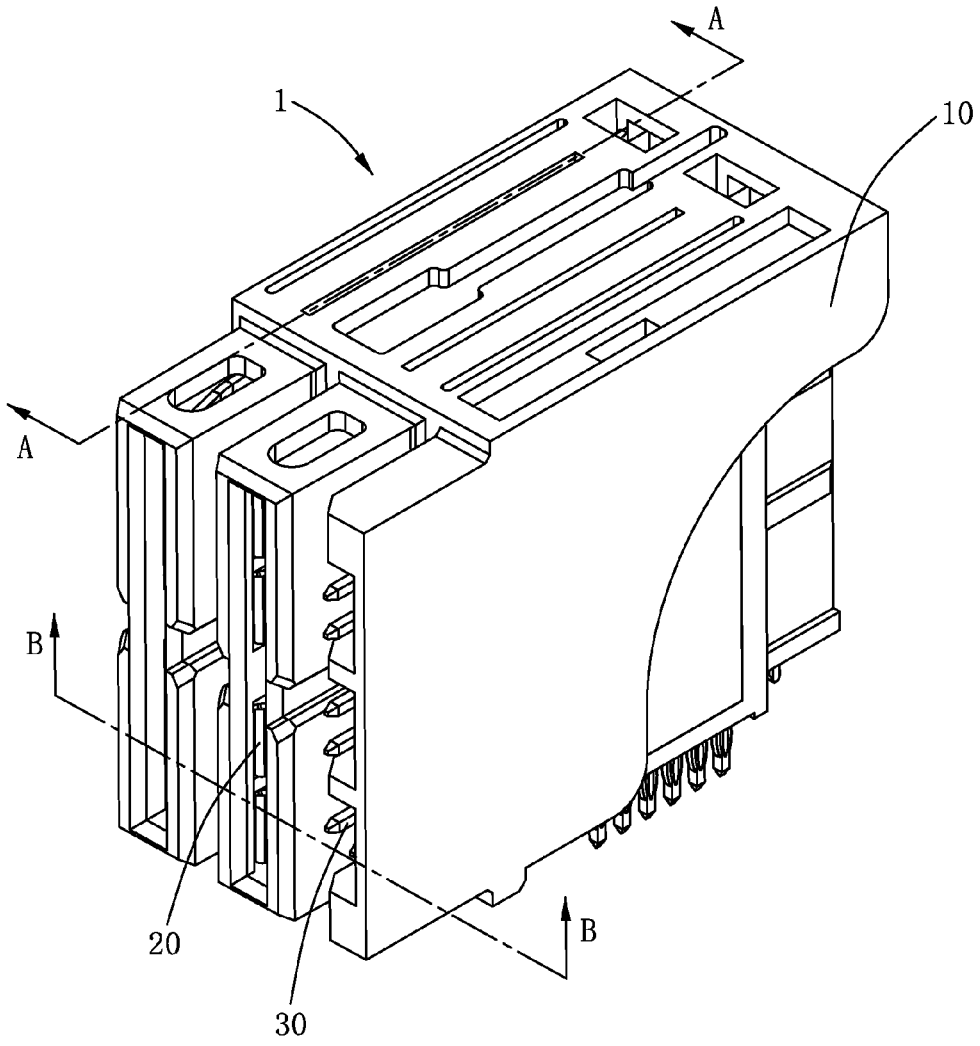
FIG. 1 is a perspective view of the electrical connector according to the present invention.
Figure 2:
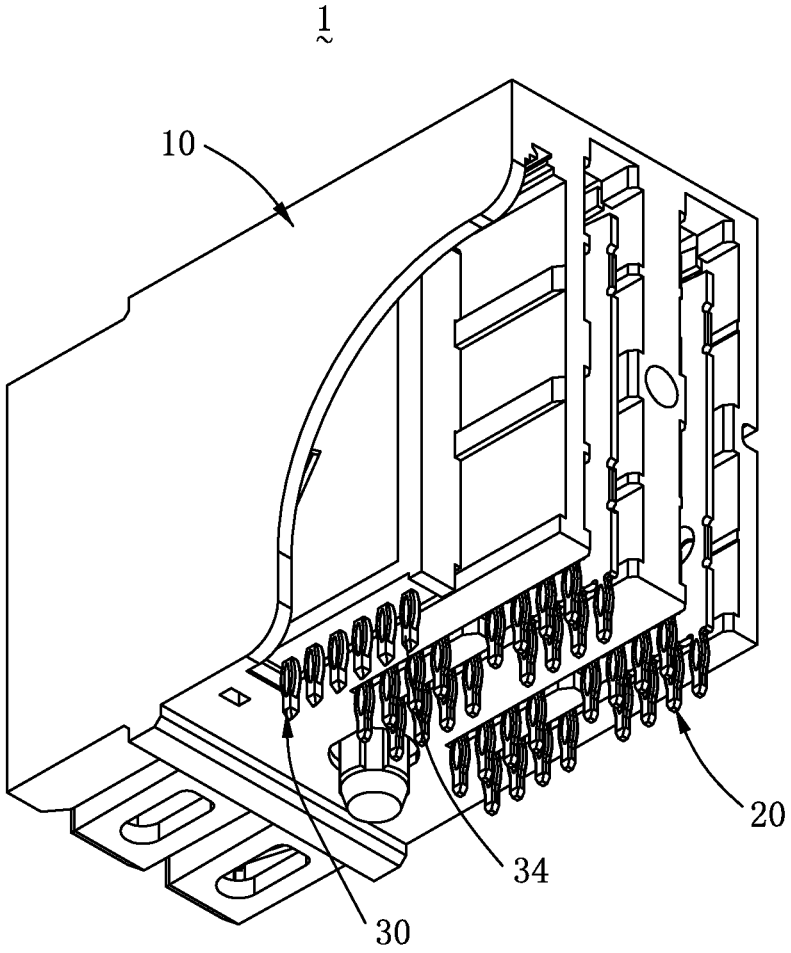
FIG. 2 is a perspective view of the electrical connector according to the present invention, which is from another angle.
Figure 3:
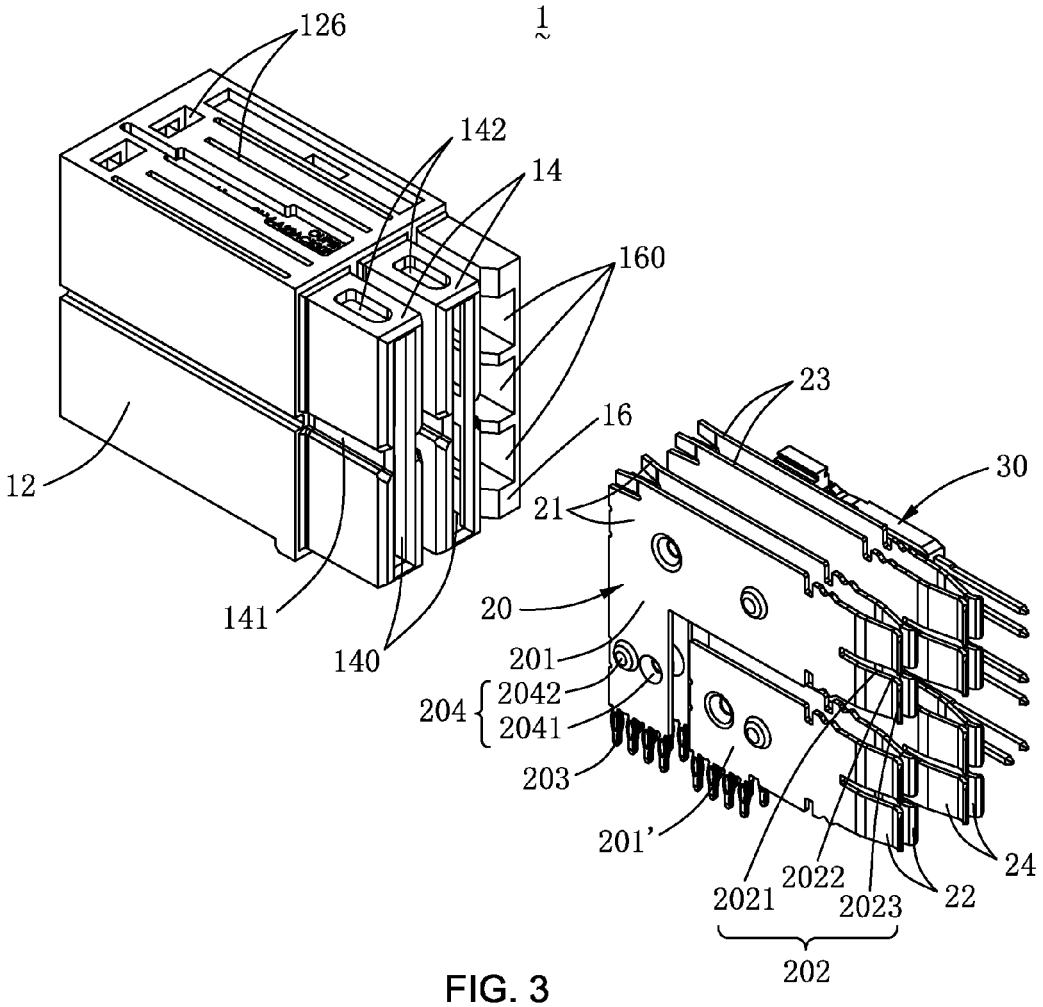
FIG. 3 is an exploded diagram of the electrical connector according to the present invention.
Figure 4:
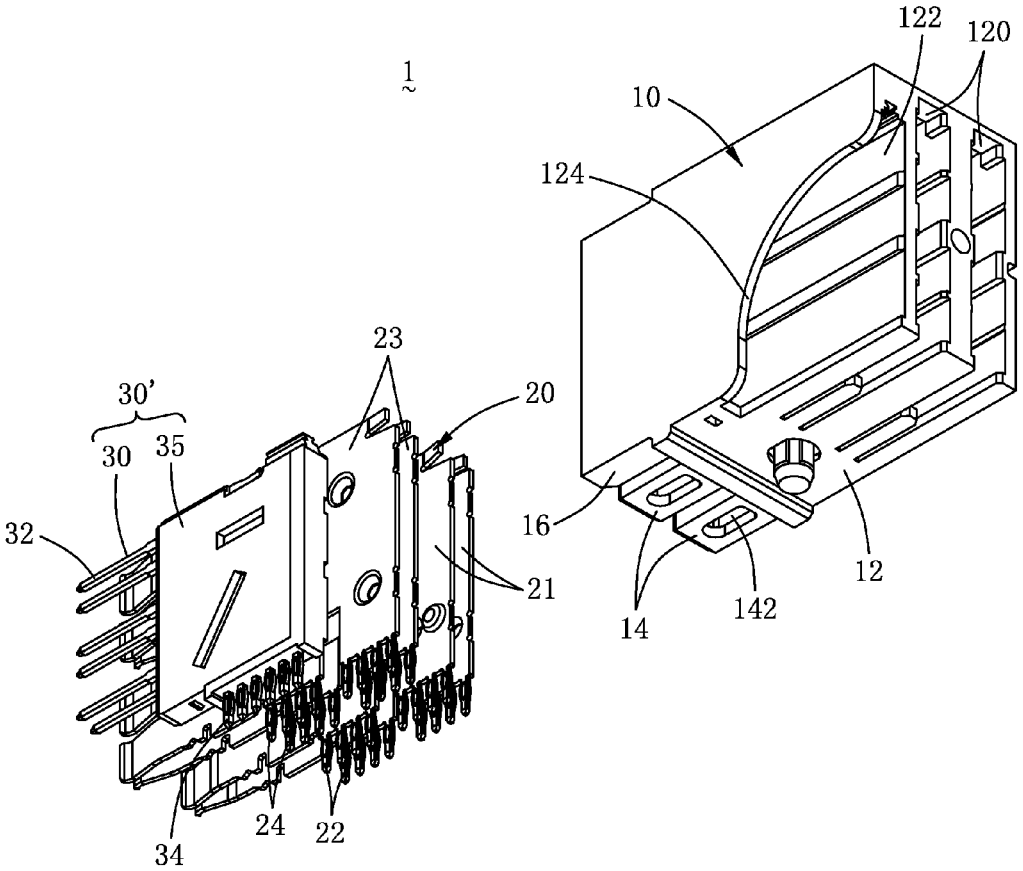
FIG. 4 is an exploded diagram of the electrical connector according to the present invention, which is from another angle.
Figure 5:
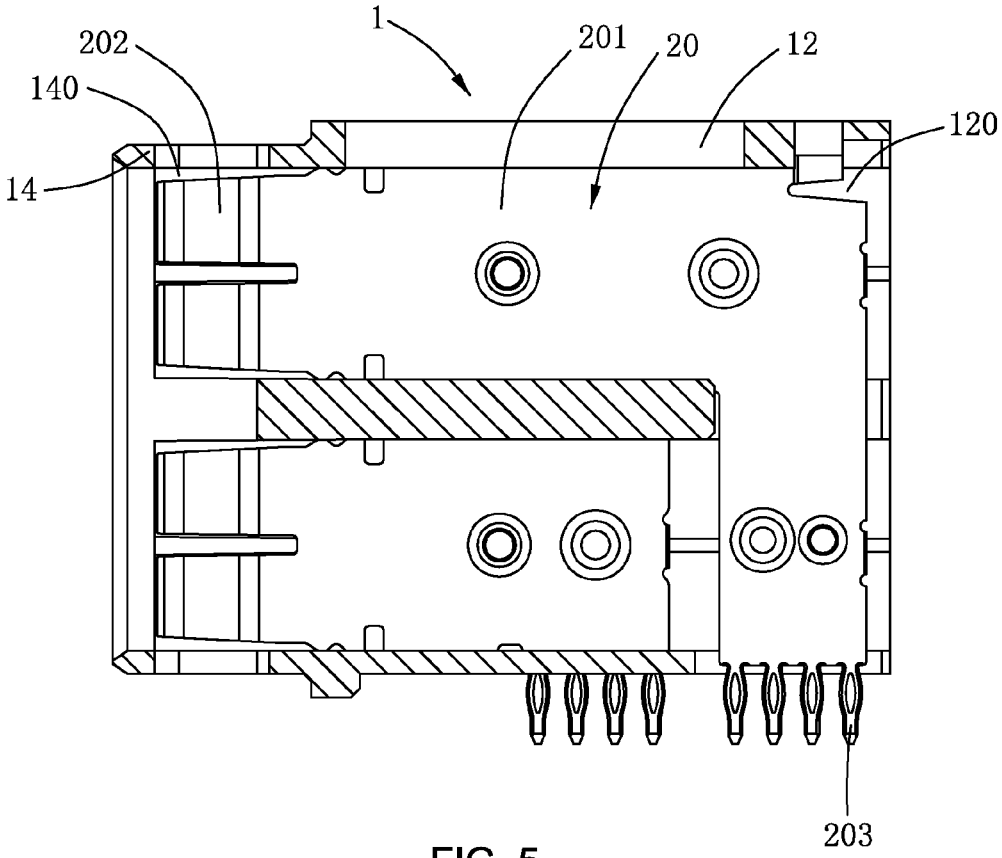
FIG. 5 is a cross-sectional diagram of the electrical connector along a vertical direction according to the present invention.
Figure 6:
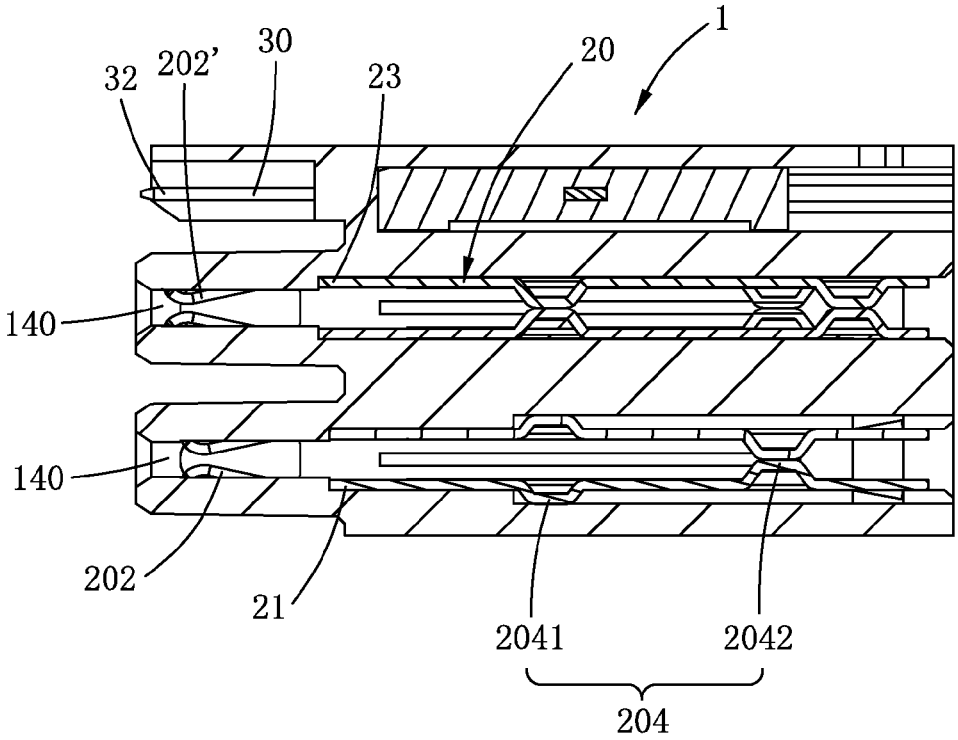
FIG. 6 is a cross-sectional diagram of the electrical connector along a horizontal direction according to the present invention.

Please refer to the electrical connector 1 illustrated in FIGS. 1 to 6 according to the present invention, wherein FIG. 1 is a perspective view of the electrical connector 1 according to the present invention; FIG. 2 is a perspective view of the electrical connector 1 according to the present invention, which is from another angle; FIG. 3 is an exploded diagram of the electrical connector 1 according to the present invention; FIG. 4 is an exploded diagram of the electrical connector 1 according to the present invention, which is from another angle; FIG. 5 is a cross-sectional diagram of the electrical connector 1 along a vertical direction according to the present invention; FIG. 6 is a cross-sectional diagram of the electrical connector 1 along a horizontal direction according to the present invention.

Please refer to FIGS. 1 to 4, the electrical connector 1 according to the present invention is an orthogonal receptacle connector having mixed ports and capability of power and signal transmission at the same time. The electrical connector 1 according to the present comprises an insulating housing 10, a plurality of power terminals 20 and a plurality of signal terminals 30.

Please refer to FIGS. 3 and 4, the insulating housing of the electrical connector 1 according to the present invention has an insulating base 12, two independent power receptacle bodies 14 forward and protruding in parallel from a front surface of the insulating base 12, a signal plug body 16 forward protruding from the front surface of the insulating base 12 and is parallel to the two power receptacle bodies 14.

In the present embodiment, the insulating base 12 is an upright rectangle, two power receptacle bodies 14 and the signal plug body 16 are also upright rectangles and are parallel and forward protruding from the front surface of the insulating base 12, the signal plug body 16 is disposed at one side of the two power receptacle bodies 14 and having a side facing the two power receptacle bodies 14 forming an open structure. The detailed structure will be explained later. When the electrical connector 1 is mounted onto a circuit board (not shown), a bottom surface of the insulating base 12 is disposed on the circuit board, while the power receptacle body 14 and signal plug body 16 are protruding outside the edge of the circuit board so as to connect to a docking connector.

Please refer to FIGS. 3 and 4, two power terminal receiving passages 120 passing through the front surface, a back surface and the bottom surface of the insulating base 12 are formed in the insulating base 12 to receive the power terminals 20. An upright power port 140 is formed in each of the front surfaces of the two power receptacle bodies 14, which is backward extending to the insulating base 12. The power port 140 is connected to the corresponding power terminal receiving passage 120.

Please refer to FIGS. 3 and 4, an signal terminal assembling space 122 adjacent to an outside wall and passing through the front surface, back surface and bottom surface of the insulating base 12 is formed on the insulating base 12 to receive the signal terminal 30. A plurality of semi-enclosed signal ports 160 arranged vertically are formed in a front surface of the signal plug body 16, which is backward extending to the insulating base 12. The signal ports 160 are connected to the signal terminal assembling space 122. In the present embodiment, an arced gap 124 is formed in the outside wall of the insulating base 12 thereby making the signal terminal assembling space 122 to be semi-enclosed to provide convenience to the assembling of signal terminals 30 and help the signal terminals 30 to enter into the signal terminal assembling space 122 successfully and further to insert into the signal plug body 16 successfully.

In the present embodiment, as the number of the power receptacle bodies 14 is two and the signal plug bodies 16 is one. It should be understood that in other embodiment, the number of power receptacle bodies 14 and signal plug bodies 16 can be adjusted based on practical needs such as one, two or above. Therefore, the number of the power receptacle bodies 14 and signal plug bodies 16 are not limited in the present invention.

In the present embodiment, three signal ports 160 are formed in the signal plug body 16, each of which receives two signal terminals 30. And as a matter of course, likewise, the number of signal ports 160 as well as the signal terminals 30 thereof is not limited.

Please refer to FIGS. 3 and 4, a straight-lined guiding groove 141 is respectively formed in each of the two outside walls of each of the power receptacle bodies 14 to provide guiding for the docking connector. Additionally, a plurality of opening holes 142 are disposed in the top surface and bottom surface of each of the power receptacle bodies 14, each of which is connected to the corresponding power port 140. At the same time, a plurality of opening holes 126 are disposed in the top surface of the insulating base 12 to be connected to the corresponding power terminal receiving passages 120 and signal terminal assembling space 122. By the designing of the opening hole 142 and gap 126, the electrical connector 1 according to the present invention can enhance the air circulation in the insulating housing 10, improve the heat dissipation of the electrical connector 1 and protect the power device or electronic device.

Please refer to FIG. 3, the power terminal 20 of the electrical connector 1 according to the present invention is retained and mounted into the power terminal receiving passage 120 of the insulating base 12, these power terminals 20 can be, based on the sizes, divided into four groups, which comprises a first group of power terminals 21, a second group of power terminals 22, a third group of power terminals 23 and a forth group of power terminals 24, each of the group of power terminals 21, 22, 23, 24 is provide with two structurally symmetrical power terminals 20. In the present embodiment, the first group of power terminals 21 and the second group of power terminals 22 are jointly assembled into one of the power port 140, while the third group of power terminals 23 and the forth group of power terminals 24 are jointly assembled into another power port 140.

As illustrated in FIG. 3, the four groups of power terminals 21, 22, 23, 24 are generally identical in structure except for size.

Hereinafter, a power terminal 20 of the first group of power terminals 21 is described in details as an example to explain the structure of the power terminal 20 according to the present invention.

Please refer to FIG. 3, the power terminal 20 of the electrical connector 1 according to the present invention includes a plate-shaped base plate 201, an elastic docking terminal 202 bent forward and extending from one side of the base plate 201, and a plurality of tails 203 downward extending from another side that is perpendicular to the one side, thus the tails 203 and the spring connection end 202 are respectively formed on each of the two perpendicular sides of the base plate 201. As illustrated in FIG. 5, the base plate 201 of the power terminal 20 is retained into the power terminal receiving passage 120 of the insulating base 12, the spring connection end 202 extends into the power port 140 of the power receptacle body 14 to facilitate the docking to the corresponding terminal of docking connector, while the tail 203 extends outside the bottom surface of insulating base 12 and is operable to be connected to the power access point on the circuit board.

In the present embodiment, as illustrated in FIG. 3, a plurality of protrusions 204 are formed on the base plate 201 of the power terminals 20, and some of the protrusions 2041 are directed at another power terminal 20 of this group of power terminals 20, so as to contact the power terminal 20 and thereby keeping the assembling interval between two power terminals 20 in the same group; and some other protrusions 2042 are directed at an opposite direction to contact the inside wall of the power terminal receiving passage 120 in the insulating base 12 so as to maintain certain assembling stability. On structure of the protrusions 204 (2041, 2042), reference can be made to FIG. 6.

In the present embodiment, as illustrated in FIG. 3, the number of spring connection ends 202 of power terminals 20 is two, each of the spring connection end 202 includes an inclining section 2021 connecting to the base plate 201, a contacting section 2022 connecting to the inclining section 2021, and a guiding section 2023 connecting to the contacting section 2022 and disposed on the free end of the spring connection end 202.

During practical assembling, the guiding sections 2023 of spring connection ends 202 of two power terminals 20 in the first group of power terminals 21 extend from each other, while the contacting sections 2022 of spring connection ends 202 of two power terminals 20 are converging to each other, as illustrated in FIG. 3. Thus, the spring connection ends 202 of two structurally symmetrical power terminals 20 in the first group of power terminals 21 jointly form an elastic engagement structure, wherein the guiding sections 2023 can jointly guide the docking terminal of docking connector to be inserted, the contacting sections 2022 can jointly engage the docking terminal, and the inclining sections 2021 can provide certain resilience for the contacting sections 2022. Accordingly, the electrical connector 1 according to the present invention can establish a stable electrical connection wi the docking connector.

In the present embodiment, the tails 203 of the power terminal 20 are needle-eyed, which can be fixed to the electrical conductive holes in the circuit board by press welding, thereby connecting the power access point on the circuit board.

Likewise, the second group of power terminals 22 includes the similar structure mentioned above, only that the first group of power terminals 21 is shaped tall and long while the second group of power terminals 22 is shaped low and short. Particularly, in the present embodiment, the difference between the first group of power terminals 21 and second group of power terminals 22 is that the base plate 201 of each power terminal 20 in the first group of power terminals 21 is shaped as an upside-downed L, while the base plate 201' of each power terminal 20 in the second group of power terminals 22 is shaped as an rectangle.

Similarly, the structures of the third group of power terminals 23 and first group of power terminals 21 are more alike while the structures of the forth group of power terminals 24 and second group of power terminals 22 are more alike. Specifically speaking, in the present embodiment, the difference between the third group of power terminals 23 and first group of power terminals 21 is that the spring connection end 202' of each piece of power terminals 20 in the third group of power terminals 23 is slightly longer (as illustrated in FIG. 6), while the spring connection end 202 of each piece of power terminals 20 in the first power terminal 21 is a little shorter, the effect thereof will be discussed in detail later.

As illustrated in FIGS. 3 and 4, the first group of power terminals 21 and second group of power terminals 22 of the electrical connector according to the present invention are jointly assembled into a power port 140 thereof, and the spring connection ends 202 of the two groups of power terminals 20 are arranged straight in line vertically in the power port 140, while the tails 203 of the two groups of power terminals 20 can be arranged in parallel into two rows based on the circuit layout on the circuit board. Correspondingly, the third group of power terminals 23 and forth group of power terminals 24 of the electrical connector 1 according to the present invention are jointly assembled into another power port 140, and the spring connection ends of the two groups of power terminals 20 are arranged straight in line vertically in the power port 140, while the tails 203 of the two groups of power terminals 20 can be arranged in parallel into two rows based on the circuit layout on the circuit board.

Furthermore, in the present embodiment, since the electrical connector 1 according to the present invention includes two power receptacle bodies 14, thus it is needed to arrange four groups of power terminals 21, 22, 23, 24, so that all the power receptacle bodies 14 each can be mounted with two groups of power terminals 20 of different sizes at the same time. Nevertheless, in other embodiments, if the electrical connector 1 has only one power receptacle body 14, then only two groups of power terminals 20 of different sizes are needed. Similarly, the number of power terminals 20 can be calculated when more other power receptacle bodies 14 are provided.

Please refer to FIG. 4, the signal terminal 30 of the electrical connector 1 according to the present invention is retained and mounted into the signal terminal assembling space 122 of the insulating base 12 and each includes a head 32 and a tail 34 perpendicular to the head 32. In the present embodiment, the signal terminal 30 is mounted into the signal terminal assembling space 122 as terminal module 30', that is, the signal terminal 30 and plastic cement 35 are integrated to form an independent signal terminal module 30', the signal terminal 30 having the head 32 extended outside the front end of the signal terminal module 30' and tail extended outside the bottom surface of the signal terminal module 30'. As illustrated in FIG. 4, the heads 32 of these signal terminals 30 are arranged straight in line vertically while the tails 34 are arranged straight in line based on the circuit layout on the circuit board, thus the tails 34 are arranged in a direction that is perpendicular to the direction in which the heads 32 are arranged. When the signal terminal 30 is assembled into the signal terminal assembling space 122 of the insulating base 12 as a module, the signal terminal 30 having head 32 extended into the signal port 160 of the signal plug body 16 and tail 34 extended outside the bottom surface of the insulating base 12 to facilitate a connection to the signal access point on the circuit board. As illustrated in FIG. 2, the tails 34 of the signal terminals 30 are basically arranged straight in line at one side of a row that is formed by the tails 203 of the power terminals 20. In the present embodiment, the tail 34 of the signal terminal 30 is needle-eyed, which is also fixed into the corresponding electrical conductive hole in the circuit board by press-welding, so as to connect the signal access point on the circuit board.

In the present embodiment, the number of signal terminals 30 is six.

Additionally, as illustrated in FIG. 6, the heads 32 of the signal terminals 30 of the electrical connector 1 according the present invention all exceed the spring connection ends 202, 202' of each of the power terminals 20, and the spring connection ends 202' of the third group of power terminals 23 and forth group of power terminals 24 in the same power port 140, compared to that of the first group of power terminals 21 and second group of power terminals 22 that are in another power port 140, are slightly longer. Therefore, in the present embodiment, the docking of the electrical connector 1 is stepped. Namely, when a docking connector is docking to the electrical connector 1 according to the present invention, the signal terminals 30 are the first the be connected, and the power terminals 20 (the third and fourth group of power terminals 23, 24) in one of the power port 140 are second to be connected, and finally the power terminals 20 (the third group and fourth group of power terminals 21, 22) in another power port 140 are connected, this design allows the electrical connector 1 according to the present invention with a character of a low insertion force while, at the same time, controlling the electrical performance of the electrical connector 1 during docking, thereby making the electrical connector 1 operable to satisfy the requirements of safety and diversity of current electronic devices.

All in all, the electrical connector 1 according to the present invention includes following advantages: the power receptacle body 14 and signal plug body 16 in the electrical connector 1 according to the present invention are both designed to be upright or vertical so as to save the edge space of a circuit board and allowing a larger number of connector ports of same or other kinds to be mounted onto the edge of the circuit board; the electrical connector 1 according to the present invention includes a character of zero insertion force and is operable to control the electrical performance of the electrical connector 1 during docking by the length design of the signal terminal 30 and the power terminal 20; also, through the opening holes 142 and gap 126, can enhance the air circulation in power system and thereby improving the performance of the electrical connector 1; moreover, via the structural design of the straight-lined guiding grooves 141, the docking of the electrical connector 1 is further provided with convenience.

What is claimed is:

1. An electrical connector comprising:

an insulating housing having an upright insulating base, at least one upright power receptacle body forward protruding from a front surface of the insulating base, and at least one upright signal plug body forward protruding from the front surface of the insulating base and parallel to the power receptacle body, wherein in the insulating base, at least one signal terminal assembling space and at least one power terminal receiving passage passing through the front surface, back surface and bottom surface thereof are formed, and the power receptacle body forms a vertical power port on a front surface thereof, and the power port is connected to the power terminal receiving passage, and the signal plug body forms at least one signal port in a front surface thereof, and the signal port is connected to the signal terminal assembling space;

a plurality of power terminals, wherein each of the power terminals is retained and mounted into the power terminal receiving passage of the insulating base, and each of the power terminals has a plate-shaped base plate, at least one spring connection end forward bent and extending from one side of the base plate, and a plurality of tails downward extending from another side of base plate perpendicular to the one side, wherein the base plate is retained into the power terminal receiving passage of the insulating base, the spring connection end extends into the power port of the power receptacle body, and the tail extends outside the bottom surface of the insulating base; the spring connection end comprises an inclining section connecting to the base plate, a contacting section connecting to the inclining section, and a guiding section connected to the contacting section and disposed at the free end of the spring connection end; wherein the power terminals are divided into two groups comprising a first group of power terminals and a second group of power terminals, and the first group of power terminals is structurally larger than the second group of power terminals by size, and the first group of power terminals and second group of power terminals are jointly assembled into the power port, and each group of power terminals includes two pieces of the power terminals, and the base plate of each piece of power terminals in the first group of power terminals is shaped as an upside-downed L, and the base plate of each piece of power terminals in the second group of power terminals is shaped as a rectangle; and a plurality of signal terminals having each retained and mounted into the signal terminal assembling space of the insulating base, wherein each of the signal terminals has a head and a tail perpendicular to the head, wherein the head extends into the signal port of the signal plug body, and the tail extends outside the bottom surface of the insulating base; the heads of the signal terminals in the signal port is arranged straight in line vertically, and the tails are also arranged straight in line and perpendicular to the direction the heads arranged.

2. The electrical connector as claimed in claim 1, wherein the guiding sections of spring connection ends of two pieces of power terminals in each of the groups of power terminals extend from each other while the contacting sections are converging to each other to jointly form an elastic engagement structure.

3. The electrical connector as claimed in claim 2, wherein the heads of the signal terminals in the signal port exceed the docking ends of each of the power terminals in the first group of power terminals and second group of power terminals.

4. The electrical connector as claimed in claim 1, wherein the electrical connector includes two of the power receptacle bodies which are forward protruding in parallel from the front surface of the insulating base and are both upright, and each of the two power receptacle bodies has the power ports, the power ports of the two power receptacle bodies are parallel to each other, the signal plug bodies are disposed at one side of the two power receptacle bodies, and an open structure is formed on a side of signal plug body facing the two power receptacle bodies, thereby making the signal port to be semi-enclosed.

5. The electrical connector as claimed in claim 4, wherein these power terminals further comprising: a third group of power terminals and a forth group of power terminals, the first group of power terminals and third group of power terminals have same structure and size, the second group of power terminals and forth group of power terminals have same structure and size, and the first group of power terminal and second group of power terminals are jointly assembled into the power port of one of the power receptacle bodies, and the third group of power terminal and forth group of power terminals are jointly assembled into the power port of another one of the power receptacle bodies.

6. The electrical connector as claimed in claim 5, wherein the guiding sections of spring connection ends of two pieces of power terminals in each of the groups of power terminals extend from each other while the contacting sections are converging to each other to jointly form an elastic engagement structure.

7. The electrical connector as claimed in claim 6, wherein the heads of the signal terminals in the signal port exceed the docking ends of each of the power terminals in the four groups of power terminals, and the docking ends of the first group of power terminals and second group of power terminals that are in the same power port, compared to that of the third group of power terminals and forth group of power terminals that are in another power port, are slightly shorter.

8. The electrical connector as claimed in claim 1, wherein a straight-lined guiding groove is respectively formed in each of the two outside walls of each of the power receptacle bodies, and at least one opening hole connecting the power interface is disposed in both the top surface and bottom surface of the power receptacle body, and a plurality of opening holes is disposed in the top surface of the insulating base to be connected to the corresponding power terminal receiving passages and signal terminal receiving passages.

9. The electrical connector as claimed in claim 1, wherein a plurality of protrusions are formed on the base plate of each of the power terminals, and some of the protrusions are directed at another power terminal of this group of power terminals to contact the power terminal, and some other protrusions are directed at an opposite direction to contact the inside wall of the corresponding power terminal receiving passage in the insulating base.

10. The electrical connector as claimed in claim 5, wherein a plurality of protrusions are formed on the base plate of each of the power terminals, and some of the protrusions are directed at another power terminal of this group of power terminals to contact the power terminal, and some other protrusions are directed at an opposite direction to contact the inside wall of the corresponding power terminal receiving passage in the insulating base.

* * * * *